US005105643A

United States Patent [19]

Bayer

[11] Patent Number: 5,105,643

[45] Date of Patent: Apr. 21, 1992

[54] METHOD OF AND APPARATUS FOR MAKING PERFORATIONS IN SPACER FRAMES FOR USE IN MULTIPLE-PANE WINDOWS

[75] Inventor: Franz Bayer, Elzach, Fed. Rep. of Germany

[73] Assignee: Franz Xaver Bayer Isolierglasfabrik KG, Elzach, Fed. Rep. of Germany

[21] Appl. No.: 558,578

[22] Filed: Jul. 27, 1990

[30] Foreign Application Priority Data

Jul. 27, 1989 [DE] Fed. Rep. of Germany ..... 3924872

[51] Int. Cl.[5] ..... B21D 28/32; B21D 28/34

[52] U.S. Cl. ..... 72/325; 72/186; 72/204; 29/163.6; 29/890.142; 29/897.312

[58] Field of Search ..... 72/325, 335, 333, 186, 72/185, 204, 130, 327, 324; 29/163.6, 890.142, 890.143, 890.1, 897.312, 897.31

[56] References Cited

U.S. PATENT DOCUMENTS

| | | | |
|---|---|---|---|
| 1,256,905 | 2/1918 | Kass | 29/163.6 |
| 1,693,011 | 11/1928 | Woodward | 72/325 |
| 2,737,831 | 3/1956 | Webb | 72/327 |
| 2,754,581 | 7/1956 | Thomas | 29/163.6 |
| 3,442,110 | 5/1969 | Walton | 72/327 |
| 3,470,598 | 10/1969 | Berthelsen | 29/897.312 |
| 3,865,144 | 2/1975 | Westhoff | 138/103 |
| 4,464,920 | 8/1984 | Stoehr | 29/163.6 |
| 4,608,802 | 9/1986 | Bayer | 52/788 |
| 4,621,511 | 11/1986 | Knudson | 72/186 |
| 4,627,263 | 12/1986 | Bayer | 72/298 |
| 4,912,837 | 4/1990 | Bayer | 29/451 |

FOREIGN PATENT DOCUMENTS

| | | | |
|---|---|---|---|
| 7426966 | 8/1974 | Fed. Rep. of Germany . | |
| 2606387 | 8/1976 | Fed. Rep. of Germany . | |
| 7925919 | 12/1979 | Fed. Rep. of Germany . | |
| 165531 | 12/1981 | Japan | 72/327 |
| 199139 | 11/1984 | Japan | 29/890.142 |

*Primary Examiner*—Daniel C. Crane
*Attorney, Agent, or Firm*—Peter K. Kontler

[57] ABSTRACT

That wall of a hollow metallic spacer frame between two spaced-apart parallel window panes separates a supply of partly granular and partly pulverulent desiccant in the interior of the frame from the space which is surrounded by the frame and is flanked by the panes. The wall is formed with a row of nipples extending from its outer side and having tips provided with holes for penetration of vapors from the space between the panes into contact with desiccant. The tips of some or all of the nipples are upset as a result of engagement by a roller so that the cross-sectional areas of the corresponding holes are reduced for the purpose of preventing penetration of pulverulent desiccant into the space while permitting the vapors to escape from the space into the interior of the spacer frame. The nipples are formed by deep drawing the ductile material of the wall prior to upsetting by the roller, and the tool which performs the deep drawing action can also serve to make holes in the tips of the nipples. The peripheral surface of the roller has a circumferentially extending groove bounded by a section of the peripheral surface which serves to upset some or all of the nipples while the roller is caused to roll along that side of the wall which later confronts the supply of desiccant in the interior of the finished spacer frame.

14 Claims, 5 Drawing Sheets

Fig. 3
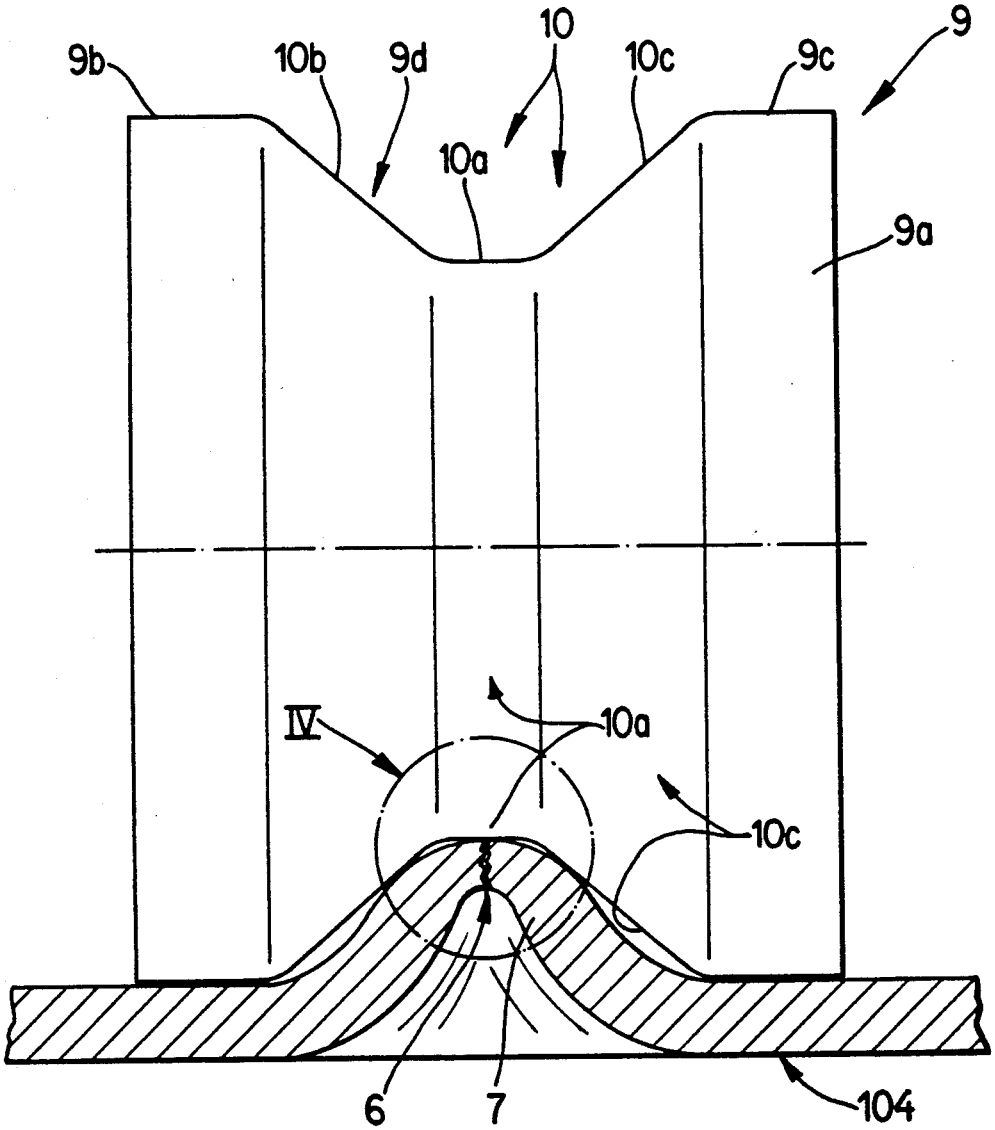
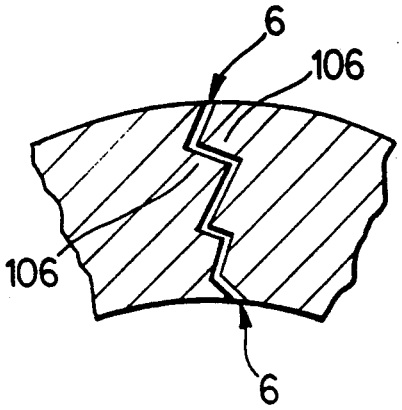
Fig. 4

METHOD OF AND APPARATUS FOR MAKING PERFORATIONS IN SPACER FRAMES FOR USE IN MULTIPLE-PANE WINDOWS

BACKGROUND OF THE INVENTION

The invention relates to improvements in spacer frames (also called spacers) which can be used between marginal portions of spaced-apart panes in so-called double windows or multiple-pane windows or analogous shatter-, bullet- or soundproof or thermally insulating laminates. More particularly, the invention relates to improvements in methods of and in apparatus for making holes in whose portions or walls of hollow spacer frames which are disposed between a supply of flowable desiccant in the interior of a frame and the space between the spaced-apart panes of a multiple-pane window or the like.

It is necessary to provide the hollow spacer frame of a multiple-pane window or a similar laminate with a plurality of holes (e.g., small perforations) which ensure that moisture in the space between the panes can escape into the interior of the frame to be absorbed by granular, pulverulent or other particulate desiccant in the interior of the frame. German Utility Model No. 74 26 966 of VAW-Leichtmetal GmbH discloses a spacer frame wherein the wall between the supply of confined desiccant and the space between the window panes is provided with pairs of neighboring elongated parallel slits. Strips of material between the slits of each pair are depressed toward the interior of the hollow frame in order to enlarge the paths for the flow of vapors from the space toward contact with the desiccant. If necessary, some of the strips are thereupon pressed inwardly to reduce the cross-sectional areas of the respective paths, i.e., to prevent penetration of particles of flowable desiccant into the space which is surrounded by the frame and is flanked by the two panes. A drawback of the frame which is described in the Utility Model is that finely comminuted desiccant which is located above the space between the panes (i.e., which is confined in the spacer frame along the upper edge of a multiple-pane window) is likely to seep through the slits in the adjacent portion of the wall and to penetrate into the space to detract from the appearance of the window. Some finely comminuted desiccant is bound to be found in the interior of the spacer frame, mainly because the frame is normally made (or is often made) by bending a straight tubular desiccant-containing blank of ductile metallic material in order to convert the blank into a square, rectangular or otherwise configurated frame. Such bending (reference may be had to commonly owned U.S. Pat. Nos. 4,627,263 and 4,912,837) invariably entails comminution of certain granulae of desiccant so that the thus obtained fine powder is likely to penetrate into the space between the panes under the action of gravity. Shaking and/or other movements of the panes during assembly with the frame promote the escape of finely comminuted desiccant into the space which is surrounded by the spacer frame. Moreover, if the multiple-pane laminate is used as a window in a motor vehicle, vibrations of the panes while the vehicle is in motion also promote penetration of finely comminuted desiccant into the aforementioned space. Still further, desiccant which is confined in the spacer frame of a multiple-pane window in a motor vehicle is likely to escape from the interior of the frame during raising or lowering of the window, under the action of wind, as a result of banging on the window or due to a combination of such influences.

German Utility Model No. 79 25 919 of Mannesmann AG discloses a spacer frame wherein the wall which separates the space between the panes from the confined supply of desiccant is formed with outwardly extending protuberances surrounding circular or slot-shaped passages for the flow of vapors from the space toward contact with the supply of desiccant. The protuberances have ragged edges which surround the passages. These passages permit finely comminuted particles of desiccant to penetrate into the space and to thus adversely affect the appearance of the laminate (such as a multiple-pane window) in which the spacer frame is put to use.

U.S. Pat. No. 3,865,144 to Westhoff discloses a spacer frame wherein the wall which separates the space between the panes from the supply of confined desiccant is formed with longitudinally extending slots and the material of the wall next to each slot is depressed through an acute angle to extend into the interior of the frame and to establish a relatively wide path for the flow of vapors toward contact with the particles of desiccant. Such slots are highly likely to permit penetration of finely comminuted desiccant into the space between the panes.

Published German patent application No. 26 06 387 of Poignon discloses a spacer frame having an elongated weakened portion which can be readily destroyed to establish a path for the flow of vapors from the space between two panes into contact with the supply of confined desiccant. This publication proposes to split the weakened portion in the region of the web to thus provide a long path for vapors. Such elongated path weakens the frame and permits escape of finely comminuted desiccant into the space between the panes.

The aforementioned commonly owned U.S. Pat. No. 4,627,263 also discloses a spacer frame having a wall with a weakened portion which is provided with perforations enabling confined desiccant to attract moisture from the space between the panes. This patent deals primarily with conversion of tubular blanks into polygonal frames and with expulsion of some desiccant from the bent corner portions of the converted blanks.

OBJECTS OF THE INVENTION

An object of the invention is to provide a novel and improved method of making spacer frames for use in multiple-pane windows and for other purposes in such a way that even small or extremely small particles of desiccant which is confined in the interior of the frame are prevented from penetrating into the space between the panes by way of passages which are provided to permit the flow of vapors from the space into contact with desiccant.

Another object of the invention is to provide a novel and improved method of making and controlling the cross-sectional areas of perforations in that wall of a hollow desiccant-containing spacer frame which separates the supply of desiccant from the space between the panes.

A further object of the invention is to provide a method of varying the cross-sectional areas of the passages for the flow of vapors from the space within the confines of a hollow spacer frame into the interior of the frame.

An additional object of the invention is to provide a simple and inexpensive method which can be practiced to reliably confine the supply of desiccant in the interior of the hollow spacer frame even if certain particles of desiccant have undergone extensive comminution during conversion of a tubular blank into a rectangular, square or otherwise configurated spacer frame.

Still another object of the invention is to provide a novel and improved apparatus for the practice of the above outlined method.

A further object of the invention is to provide the apparatus with novel and improved means for making holes in, and for thereupon controlling the cross-sectional areas of, such holes preparatory to conversion of a blank into a hollow spacer frame for use in multiple-pane windows and other laminates.

Another object of the invention is to provide an apparatus which can establish smaller and larger paths for the flow of vapors from the space between two panes into the interior of a hollow spacer frame.

An additional object of the invention is to provide an apparatus which ensures that the spacer frame which is shaped therein prevents the escape of finely comminuted desiccant by gravity flow, especially from that portion or from those portions of a frame which are located at a level above the space between two spaced-apart parallel glass panes or the like.

A further object of the invention is to provide a novel and improved spacer frame which is produced in accordance with the above outlined method.

Another object of the invention is to provide a novel and improved spacer frame which is obtained by resorting to the above outlined apparatus.

An additional object of the invention is to provide a spacer frame which can reliably confine a supply of desiccant, even if the desiccant contains minute particles which are much smaller than an average particle and even if the frame or a multiple-pane laminate containing the frame is subjected to repeated and pronounced vibratory and/or other stresses which would be likely to promote the escape of desiccant from the interior of the frame.

Another object of the invention is to provide a simple and inexpensive spacer frame which is designed to establish larger and smaller paths for the flow of vapors from the space within the confines of the frame into contact with the desiccant.

A further object of the invention is to provide a spacer frame which can establish adequate paths for the flow of vapors from the space between the panes while reliably preventing penetration of desiccant into such space.

SUMMARY OF THE INVENTION

One feature of the present invention resides in the provision of a method of regulating the permeability of a ductile wall forming or about to form part of a hollow spacer frame for confinement of a flowable desiccant and for use between two panes (e.g., two light-transmitting glass panes) defining a space which is surrounded by one side of the wall while the other side of the wall confronts the confined desiccant. The method comprises the steps of converting spaced-apart portions of the wall into hollow nipples which extend beyond the other side of the wall, puncturing the nipples to form holes which are remote from the other side of the wall, and thereupon upsetting at least some of the nipples to reduce the sizes of the respective holes.

The converting step can include deep drawing the spaced-apart portions of the wall in a direction from the one side beyond the other side of the wall with attendant reduction of thickness of those portions of the nipples which are remotest from the sides of the wall. The puncturing step of such method can comprise making holes in the remotest portions of the nipples, preferably simultaneously with the converting step, and the upsetting step of such method can include moving the punctured remotest portions of at least some nipples toward the one side of the wall.

The method can further comprise the steps of forming a flat blank in the form of a web which consists of ductile metallic material and includes the ductile wall, and transforming the blank into the hollow spacer frame subsequent to the converting, puncturing and upsetting steps.

At least one of the converting and upsetting steps can include providing at least some of the nipples with a substantially convex external surface at the other side of the wall.

The converting step preferably includes imparting to each nipple a height of more than 0.2 mm in a direction away from the other side of the wall. The upsetting step preferably comprises reducing the height of at least some of the nipples to a height of at least 0.2 mm.

Another feature of the present invention resides in the provision of a hollow spacer frame for confinement of a supply of flowable desiccant and for use between two panes which define a space to be sealed from the atmosphere. The frame comprises a wall having an inner side surrounding the space between the two panes which are spaced apart by the frame and an outer side which confronts the supply of desiccant in the hollow frame. The wall has a plurality of hollow nipples which extend beyond the outer side of the wall and have holes which are remote from the outer side of the wall. Each nipple has a tip which is remotest from the outer side of the wall, and the holes are preferably provided in the tips of the nipples.

Each of the nipples has a height which preferably exceeds or is not less than 0.2 mm, as measured from the outer side of the wall.

The supply of flowable desiccant normally consists essentially of particles having a predetermined minimum diameter, and each nipple has a height (as measured from the outer side of the wall) of at least one-sixth of the predetermined diameter.

At least some of the nipples can have mating teeth which surround the respective holes; such teeth can be formed or rendered more pronounced as a result of the aforediscussed upsetting step.

The nipples can include a first group of nipples with holes having a first cross-sectional area and a second group of nipples with holes having a smaller second cross-sectional area. The height of the second group of nipples (as measured from the outer side of the wall) is preferably less than the height of the first group of nipples.

A further feature of the invention resides in the provision of an apparatus for varying the permeability of a ductile strip prior to conversion of a portion of the strip into a wall in a hollow spacer frame for confinement of flowable desiccant and for use between two panes defining a space which is surrounded by one side of the converted strip while the other side of the converted strip confronts the confined desiccant. The apparatus comprises at least one tool having means for providing the strip with at least one row of hollow nipples each extending beyond the other side of the strip and each having a hole which is remote from the other side of the strip, and means for reducing the height of at least some of the nipples (as measured from the other side of the strip) with attendant reduction of the sizes of holes in the thus shortened nipples. The nipples are preferably configurated in such a way that their tips (i.e., those portions of the nipples which are remotest from the other side of the strip) are provided with the respective holes. The height reducing means preferably includes a roller having a peripheral surface including a section arranged to upset the tips of at least some of the nipples as a result of rolling the roller along the other side of the strip. Such other side of the strip includes two elongated portions which flank the at least one row of nipples, and the peripheral surface of the roller preferably includes two spaced-apart annular sections which serve to roll along the aforementioned portions of the outer side of the strip, and an annular groove between the two annular sections. The first mentioned (third) section of the peripheral surface of the roller surrounds the groove and serves to upset at least some of the nipples while the annular sections roll along the respective portions of the outer side of the strip.

The initial width of at least some of the nipples (as measured transversely of the strip) can exceed the width of one or more portions of the groove so that the third section of the peripheral surface of the roller can reduce the width of those nipples which enter the one or more relatively narrow portions of the groove.

The height of the nipples prior to engagement by the third section of the peripheral surface of the roller can exceed the minimum depth of the groove in the peripheral surface of the roller.

The third section of the peripheral surface of the roller can have a substantially U-shaped or an at least partially concave or a substantially trapeziform cross-sectional outline.

The groove can include at least one first portion having a first depth and at least one second portion having a greater second depth. These portions of the groove extend in the circumferential direction of the roller.

The novel features which are considered as characteristic of the invention are set forth in particular in the appended claims. The improved spacer frame and the apparatus for making the frame, as well as the method of making the frame, together with additional features and advantages thereof, will be best understood upon perusal of the following detailed description of certain presently preferred specific embodiments with reference to the accompanying drawing.

BRIEF DESCRIPTION OF THE DRAWING

FIG. 3 is a sectional view of a blank similar to that of FIG. 2 and further showing a modified roller-shaped tool which is in the process of upsetting a nipple of the blank;

FIG. 4 is a greatly enlarged view of a detail within the phantom-line circle IV in FIG. 3;

DESCRIPTION OF PREFERRED EMBODIMENTS

Figure 6:
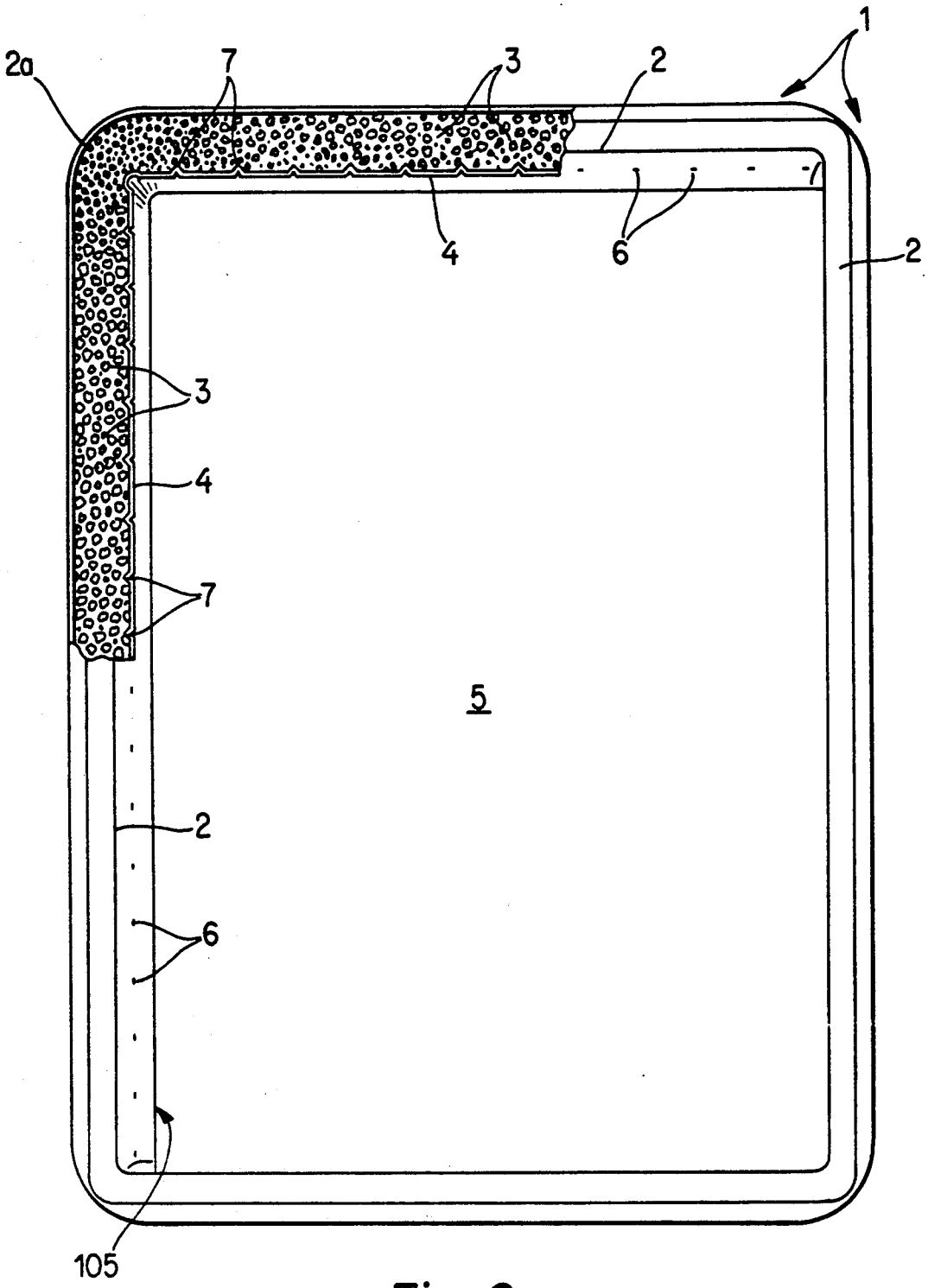
FIG. 6 is an elevational view of a multiple-pane window with the front pane omitted and with a finished hollow spacer frame partly broken away.

FIG. 6 shows a rectangular spacer frame 1 which is installed between two light-transmitting panes 5 (only one shown) of glass or other suitable material. The four straight elongated parts 2 of the frame 1 are disposed between the marginal portions of the panes 5 and surround a rectangular space or compartment 105 which is flanked by the panes and should remain sealed from the surrounding atmosphere. The frame 1 is hollow and confines a supply of desiccant 3 consisting primarily of particles having a size well in excess of 0.2 mm. Some of the particles are crushed at the corners 2*a* between neighboring mutually inclined straight parts 2 as a result of bending of an originally tubular blank which has been converted into the illustrated frame, e.g., in a manner as described, claimed and shown in the aforementioned commonly owned U.S. Pat. No. 4,627,263.

The frame 1 includes a wall 4 which is disposed between the supply of desiccant 3 and the space or compartment 105 and is provided with at least one row of longitudinally spaced-apart perforations or holes 6 which are formed in accordance with the method and in the apparatus of the present invention. The purpose of the holes 6 is to permit penetration of vapors (if any) from the space 105 into the interior of the spacer frame 1, i.e., into contact with the supply of desiccant 3. At the same time, the holes 6 should reliably prevent penetration of any, even very small or extremely small, particles of desiccant into the space 105 because this would detract from the appearance of the twin-pane window including the frame 1 and the panes 5.

Figure 1:
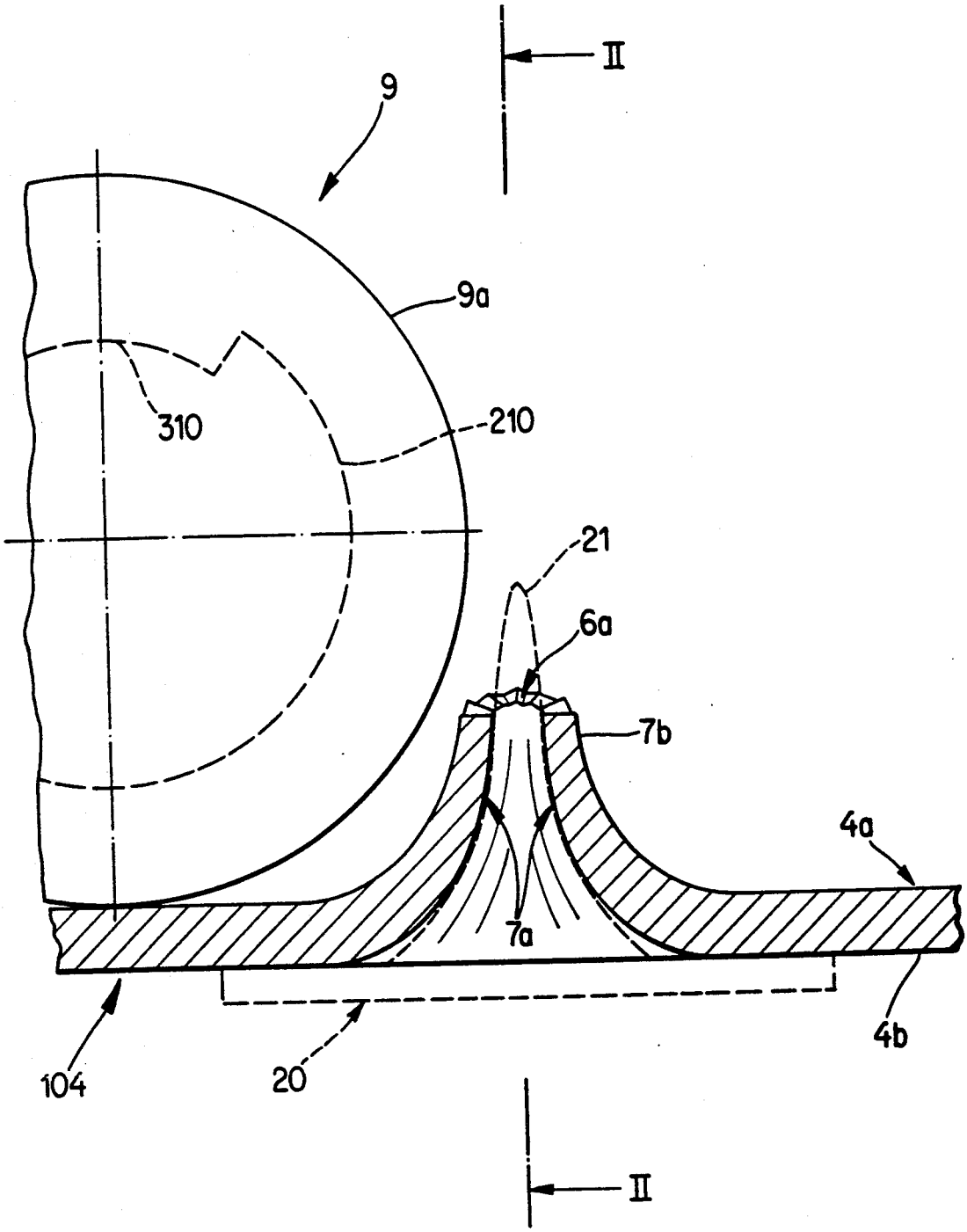
FIG. 1 is a greatly enlarged fragmentary longitudinal sectional view of a strip-shaped blank of ductile metallic material which has been formed with a row of spaced apart punctured nipples (only one shown) by a combined deep drawing and perforating tool, the illustrated nipple being about to be shortened or upset by a rotary roller-shaped height-reducing tool.

FIG. 1 shows a portion of a deep drawing tool 20 which is used to provide a median portion of an elongated flat strip-shaped or web-shaped blank 104 with a row of hollow nipples 7*a* each having a tip 7*b* provided with a hole 6*a*. The nipple 7*a* resembles the frustum of a hollow cone and extends beyond that side (4*a*) of the blank 104 which is the outer side of the wall 4 in the finished spacer frame 1 and directly contacts the supply of desiccant 3. The side 4*b* of the blank 104 includes that side of the wall 4 which directly surrounds the space 105 between the panes 5 in an assembled multiple-pane window. The hole 6*a* is formed by the piercing portion 21 of the deep drawing tool 20 which can resemble a wheel having a set of suitably distributed radially outwardly extending projections which constitute the piercing portions 21. The exact manner of moving the tool 20 relative to the blank 104 and/or vice versa forms no part of the invention; for example, the tool 20 can be mounted for rotation about a horizontal axis and the blank 104 can be moved tangentially of the tool 20 while being pressed toward the axis of the tool in order to ensure that the piercing portions 21 penetrate into and through selected portions of the blank in a direction from the side 4b toward the side 4a. The nipples 7 (see FIGS. 2 and 5), namely the converted or deformed nipples 7a, extend into the internal space of the finished spacer frame 1, i.e., into the space which receives the supply of desiccant 3.

The improved apparatus further comprises a roller 9 having a peripheral surface 9a with two spaced-apart annular (cylindrical) sections 9b, 9c and a third section 9d bounding a circumferentially extending annular groove 10 (see particularly FIGS. 2 and 3) of the roller. The depth of a portion of or of the entire groove 10 (as measured radially of the roller 9) is less than the height of a freshly formed nipple 7a so that, when the cylindrical sections 9b, 9c of the peripheral surface 9a are caused to roll along the adjacent portions 4a', 4a'' of the side 4a of the blank 104, the third section 9d of the peripheral surface 9a upsets the tips 7b of successive (or selected) nipples 7a (depending upon the configuration of the section 9d) to thus reduce the cross-sectional areas of the respective openings 6a, i.e., to convert at least some of the nipples 7a into shortened nipples 7 with slightly or much smaller openings 6 which permit the passage of vapors but effectively prevent penetration of small or very small particles of desiccant into the space 105, i.e., out of the space for the supply of desiccant 3 introduced into a tubular blank which is obtained in response to suitable shaping of the perforated blank 104.

Figure 2:
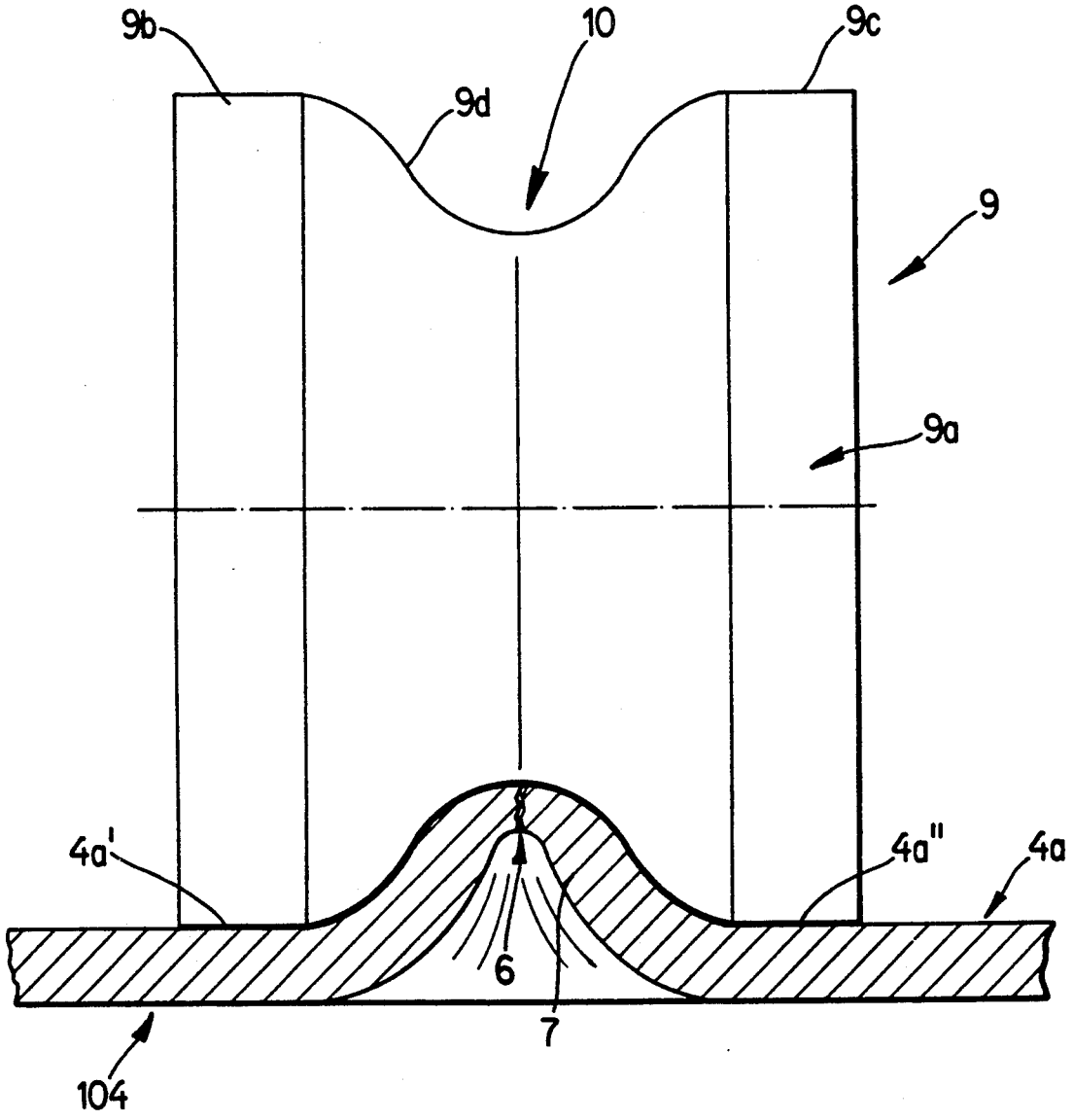
FIG. 2 is a sectional view of the blank substantially as seen in the direction of arrows from the line II—II of FIG. 1, the roller-shaped tool being shown in a position in which it has completed a shortening of the nipple and a partial closing of the hole in the tip of the nipple.
Figure 5:
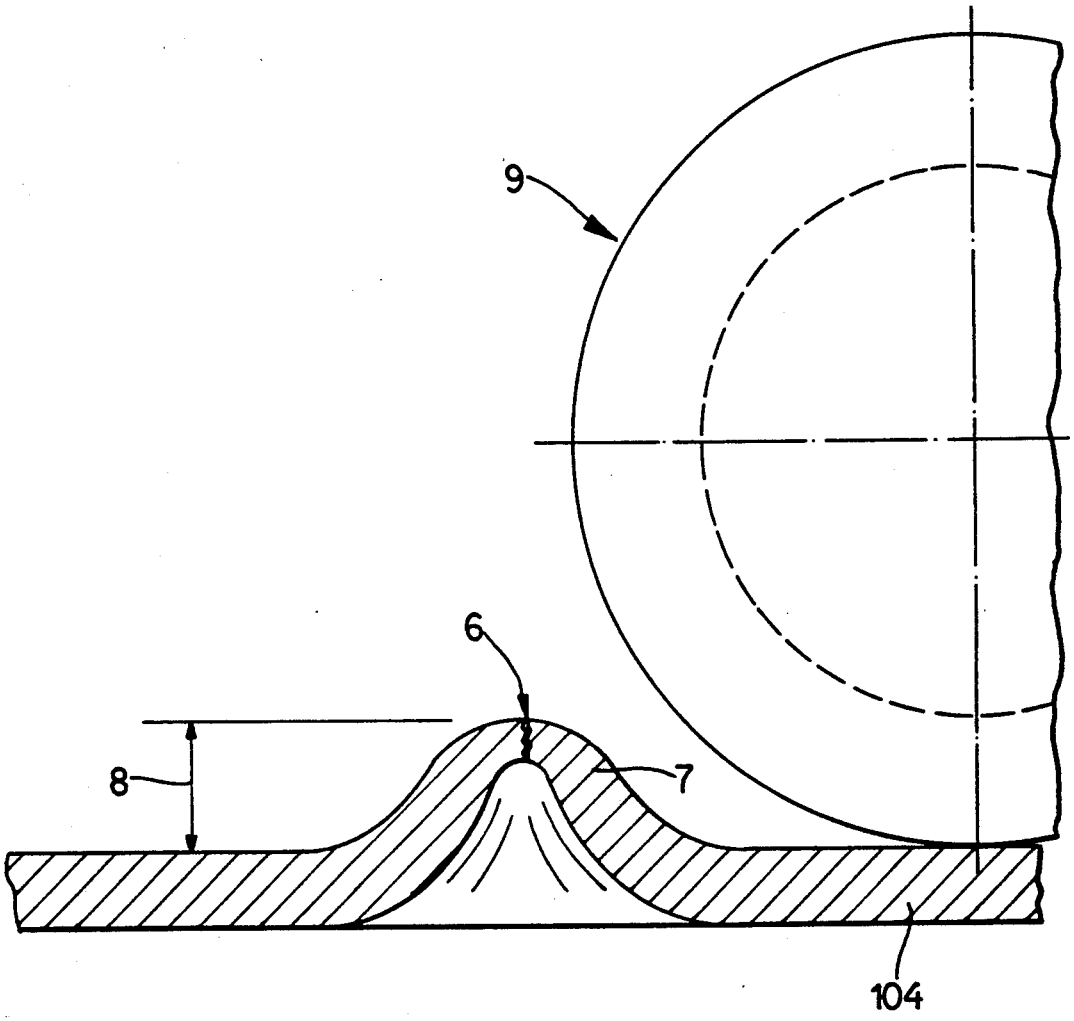
FIG. 5 is a view corresponding to that of FIG. 1 but showing the roller-shaped tool in a position downstream of the freshly upset nipple.

FIG. 1 shows the roller 9 prior to deformation of the tip 7b of the illustrated nipple 7a; FIG. 2 shows the third section 9d of the peripheral surface 9a of the roller 9 in the course of an upsetting or deforming step; and FIG. 5 shows the roller 9 upon completion of the upsetting step. The height (8) of the shortened or upset nipple 7 is preferably not less than 0.2 mm and can be more (e.g., 0.4 mm), as long as it suffices to ensure that the smallest (comminuted) particles of desiccant (i.e., particles which are obtained as a result of unavoidable crushing of some of the particles having a standard size) can come to rest at the side 4a of the top horizontal part 2 of the spacer frame 1 which is shown in FIG. 6. Such minute particles descend onto the side 4a by gravity and should be prevented from passing through the reduced holes 6 of the adjacent nipples 7, i.e., they should be prevented from entering the space 105 from above, e.g., as a result of shaking of a window which includes two panes 5 and a frame 1 and is installed in the door of a motor vehicle.

It is preferred to select the height (8) of an upset nipple 7 in such a way that it exceeds approximately one-fifth or one-sixth of the diameter of a standard-size particle of desiccant. For example, the height 8 can be between 0.2 and 0.3 mm. However, it is equally possible to make much larger nipples 7, e.g., nipples having a height 8 of 0.5 to 1 mm. The exact height of an upset nipple 7 will depend on a variety of factors such as the thickness of the wall 4 and the cross-sectional area of a frame part 2.

A comparison of FIGS. 1 and 2 will reveal that the width of a nipple 7a (prior to upsetting and as measured transversely of the blank 104) at least equals but normally exceeds the width of the groove 10 (as measured in the axial direction of the roller 9). Thus, as the sections 9b, 9c of the peripheral surface 9a roll along the adjacent portions 4a', 4a'' of the upper side 4a of the blank 104 (at the two sides of the row of nipples 7), the section 9d of the peripheral surface 9a actually narrows successive or selected nipples 7a and imparts to the outer side of each upset nipple 7 a shape which is complementary to the cross-sectional outline on the section 9d. The upset nipple 7 of FIGS. 2 and 3 has a largely convex outline because the section 9d of the roller 9 of FIGS. 1, 2 and 5 has a generally concave cross-sectional outline. However, and as shown in FIG. 3, it is equally possible to employ a roller 9 wherein the peripheral surface 9a is formed with a groove 10 having a substantially trapeziform cross-sectional outline bounded by three mutually inclined parts 10a, 10b, 10c of the section 9d. FIG. 3 further shows that the width of the groove 10 can exceed the maximum diameter of a nipple 7a so that only the part 10a of the section 9d actually deforms the nipple 7a at the tip, i.e., at that part which is formed with the hole 6a (converted into the smaller hole 6 of FIG. 3 or 4).

As can be seen in FIG. 4, upsetting of the tip of a nipple 7a can result in such deformation of (i.e., in imparting of an irregular shape to) the respective hole 6a that the thus obtained smaller hole 6 is bounded or defined, at least in part, by mating or partially mating teeth 106 establishing a meandering path for the flow of vapors from the space 105 into the interior of the finished spacer frame 1. This even further reduces the likelihood of escape of small or very small particles of desiccant from the internal space of the spacer frame.

Of course, the depth of the groove 10 which is shown in FIG. 3 and/or the height of undeformed nipples 7a can be selected in such a way that some or all of the nipples 7a are upset by the centrally located part 10a of the section 9d as well as by the adjacent parts 10d, 10c of the section 9d. A thus deformed nipple 7 then exhibits three external facets, one formed by the part 10a, another formed by the part 10b and the third formed by the part 10c of the section 9d. Deformation of a nipple 7a by the parts 10b, 10c of section 9d of the peripheral surface 9a of the roller 9 contributes to a further reduction of the cross-sectional area of the respective hole 6a (i.e., it results in conversion of hole 6a into a hole 6 which is even less likely to permit escape of minute particles of desiccant into the space 105 between the panes 5 of an assembled multiple-pane window.

If it is desired to provide the wall 4 with a first group of nipples 7 having relatively small holes 6 (e.g., in that portion of the wall 4 which is located above the space 105 in FIG. 6) and with at least one second group of nipples 7 having larger holes 6 (e.g., in that portion of the wall 4 which is located beneath the space 105 of FIG. 6), the wheel 9 can be formed with a groove 10 having at least one first portion 210 (FIG. 1) of first depth and at least one second portion 310 of greater second depth. Those nipples 7a which enter the portion 310 are subjected to a less pronounced upsetting or deforming action (or are not upset at all), and the nipples 7a which enter the portion 210 are subjected to a more pronounced upsetting action. Similar or identical results can be achieved by employing a first roller 9 with a relatively shallow groove 10 to bring about a rather pronounced upsetting action upon a first group of nipples 7a, and by employing a second roller 9 with a deeper groove 10 to effect a less pronounced upsetting of the remaining nipples 7a. An apparatus employing a roller having a circumferentially extending groove 10 with deeper and shallower portions (or two rollers having grooves of different depths) ensures that the combined cross-sectional area of all holes 6 suffices to permit escape of vapors from the space 105 without, however, permitting escape of any particles of desiccant from the interior of the spacer frame 1 into the space 105. A large majority of particles of desiccant are much too large to escape through the originally formed holes 6a, and all of the particles are sufficiently large to be intercepted by the tips 7b of deformed nipples 7.

The manner of converting a flat blank (104) into a tubular blank which defines a space for a supply of desiccant is well known in the art and need not be described here. Once the flat blank is converted into a tubular blank and the tubular blank is filled or partially filled with desiccant, the tubular blank is converted into a spacer frame 1, e.g., in a manner as described in the aforediscussed commonly owned U.S. Pat. No. 4,627,263. The ends of the thus obtained polygonal or otherwise configurated spacer frame can be sealed by a plug of hardenable material in a manner as described, shown and claimed in commonly owned U.S. Pat. No. 4,608,802.

An advantage of making nipples 7a in a flat strip or web 104 rather than in a partially shaped spacer frame is that the manipulation of a strip- or web-shaped blank is simpler and the nipples can be formed with a higher degree of accuracy. The same applies for the upsetting step, i.e., for conversion of originally formed nipples 7a into nipples 7 which have been treated by the roller 9 or an equivalent tool. The strip 104 can rest on a solid back support (e.g., an anvil) while the cylindrical sections 9b, 9c of the peripheral surface 9a of the roller 9 are caused to roll along the adjacent portions 4a', 4a'' of the side 4a of the strip 104. This contributes to predictability of the upsetting operation.

The conversion of the originally formed relatively high nipples 7a into nipples 7 of the type shown in FIGS. 2–5 exhibits the advantage that at least the tips 7b of the converted or upset nipples 7 are provided with substantially convex external surfaces. The surface bounding the reduced opening 6 of a converted or upset nipple 7 is preferably toothed or corrugated (as shown in FIG. 4) in order to further reduce the likelihood of penetration of minute particles of crushed granulae of desiccant into the interior of the converted nipple 7 and thence into the space 105 between the panes 5 of a multiple-pane window or an analogous laminated structure. The mating teeth 106 of the surface bounding the hole 6 of a converted nipple 7 provide adequate space for the flow of vapors from the space 105 into the interior of the finished spacer frame 1 but are highly unlikely to permit penetration of fragments of desiccant into the space 105.

Though it is possible to provide each freshly formed nipple 7a with two or more holes 6a, it is presently preferred to provide each such freshly formed nipple with a single hole 6a which is provided in the tip 7b of the respective nipple, i.e., at a maximum distance from the sides 4a, 4b of the respective strip or web 104. This is particularly desirable in connection with nipples 7 which are provided in the wall 4 of the top horizontal part 2 of the spacer frame 1 of FIG. 6 because the distance of the reduced holes 6 from the side 4a of such wall portion suffices to provide room for small or smallest crushed particles of desiccant which descend in the interior of the top horizontal part by gravity to come to rest on the respective portion of the wall 4. Such minute particles of crushed desiccant surround the external surfaces of the upwardly extending upset nipples 7 and are held by gravity against any movement toward the holes 6 of such nipples.

An advantage of the improved method and of the improved spacer frame 1 is that the nipples 7 are hardly detectable with the naked eye. The reason is that the nipples 7 extend into the interior of the hollow spacer frame 1 and that their dimensions are sufficiently small to ensure that only a careful observation of the exposed side 4b of the wall 4 will reveal the presence of craters, i.e., of spaces which are surrounded by the internal surfaces of the nipples 7. The narrowed holes 6 are not visible at all; in fact, even the dimensions of originally formed holes 6a are or can be so small that they cannot be seen from the side 4b of the wall 4.

The making of openings or holes 6a in the tips 7b of the originally formed nipples 7a exhibits the additional advantage that the thickness of the tips 7b is less than the thickness of the remaining major portions of the originally formed nipples 7a, i.e., the making of holes 6a in the tips 7b can be completed with a minimum of effort. The making of relatively small holes 6a is desirable on the additional ground that this does not result in unpredictable deformation of surfaces immediately surrounding the holes, i.e., the section 9d of the peripheral surface 9a of a roller 9 is more likely to encounter predictable circumstances for upsetting of the tips 7b of some or all nipples 7a in a highly predictable manner.

A very important advantage of the improved method and spacer frame is that minute particles of crushed desiccant above the top portion of the wall 4 in FIG. 6 descend to a level beneath the holes 6 of the respective upset nipples 7 so that such minute particles of desiccant are extremely unlikely to find their way to the upper ends of the reduced holes 6 and eventually into the space 105 beneath the upper horizontal part 2 of the spacer frame 1. Since the height of the miniature volcano-like nipples 7 is preferably not less than 0.2 mm, this suffices to provide beneath the holes 6 of the topmost nipples 7 in the frame 1 ample space for gravitational descent of minute particles of desiccant onto the side 4a of the topmost portion of the wall 4 at a level beneath the openings 7 of such nipples. The upset nipples 7 are not readily detectable from either side of the wall 4, not only due to convex or substantially convex shape of the exposed sides of the nipples but also due to their rather small height (e.g., between 0.2 and 0.3 mm).

Since the sections 9b, 9c of the peripheral surface 9a of the roller 9 directly contact the portions 4a', 4a'' of the respective side 4a of the flat strip or blank 104, the upsetting or deforming action of the section 9d is highly predictable so that, if the nipples 7a have a predetermined height prior to treatment by the roller 9, each treated nipple 7 invariably exhibits a predetermined height (corresponding to the depth of the respective portion of the groove 10) and the extent to which the cross-sectional area of the respective hole 6a is reduced (to constitute a hole 6) is also predictable and can be selected with a view to ensure interception of all, even very small, particles of crushed desiccant. Since the nipples 7a normally form an elongated row, they can serve as a guide means for the roller 9, i.e., the roller will be compelled to advance in a predetermined direction as soon as one or more nipples 7a enter its circumferentially extending groove 10. This ensures that each of a short or long series of nipples 7a will be deformed or upset in a highly predictable manner. If the section 9d of the peripheral surface 9a of the roller 9 is shaped in a manner as shown in FIG. 3, the part 10a of the section 9c pushes or can push some of the ductile material toward and even into contact with the parts 10b and 10c to ensure that the tip 7*b* of the deformed nipple 7 will assume a predetermined shape. The facets 10*b*, 10*c* then contribute to the shaping of the surface which surrounds the reduced hole 6, e.g., to impart to the surface a serrated shape such as that shown in FIG. 4.

It has been found that, if the wall 4 of the spacer frame 1 is provided with nipples 7 in the regions of the four corners 2*a*, the holes 6 of these nipples 7 also-prevent penetration of minute particles of crushed desiccant even though the corners 2*a* constitute those regions of the spacer frame 1 where the particles of desiccant 3 are subjected to most pronounced crushing or comminuting action as a result of pronounced bending of the originally straight tubular blank for the purpose of converting the blank into a spacer frame.

If the wall 4 of the spacer frame 1 comprises nipples 7 and nipples 7*a* (i.e., if the wall 4 also contains nipples which have undergone minimal deformation or no deformation at all due to suitable configuration of the corresponding portion or portions 310 of the groove 10), the undeformed nipples 7*a* can alternate with deformed nipples 7 or the undeformed nipples can be bunched or grouped together, e.g., along the vertical parts 2 and along the lower horizontal part 2 of the spacer frame 1 which is shown in FIG. 6. For example, the arrangement may be such that individual undeformed nipples 7*a* alternate with sets of two, three or more deformed or upset nipples 7, as seen in the longitudinal direction of the wall 4. The length of each deeper portion 310 of the groove 10 can be readily selected in such a way that at least one selected nipple 7*a* remains unchanged (undeformed) during each revolution of the roller 9 along the side 4*a* of the strip 104. As mentioned above, the depth of the portion or portions 310 can be selected in such a way that a nipple 7*a* is not deformed at all or is deformed less than the nipples 7*a* which are engaged by that portion of the section 9*d* which surrounds the shallower portion or portions 210 of the groove 10. Since the non-deformed or less deformed nipples 7*a* are taller than the deformed nipples 7, the nipples 7*a* maintain their openings 6*a* at a greater distance from the side 4*a* of the wall 4 so that they are not likely to permit escape of minute particles of crushed desiccant 3 even if they extend upwardly from the upper horizontal part of the wall 4 which is shown in FIG. 6.

The improved spacer frame 1 can be furnished in many different sizes and shapes. The combined cross-sectional area of the holes 6*a* and/or 6 in all of the nipples 7*a* and/or 7 suffices to ensure absorption of vapors by the desiccant during making of the multiple-pane laminate. The manner of sealing the space 105 from the atmosphere is well known and need not be described here; such sealing is necessary in order to prevent penetration of moisture into the space 105 during storage and/or in actual use of the ultimate product.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

The manner of converting a flat strip of ductile metallic material into a tube which is ready to receive a supply of desiccant is disclosed, for example in German Utility Model No. 74 26 966 published Nov. 14, 1974 to VAW-Leichmetall GmbH.

I claim:

1. A method of regulating the permeability of a ductile wall forming part of a spacer frame for confinement of a flowable particulate desiccant and for use between two panes defining a space which is surrounded by one side of the wall while the other side of the wall confronts the confined desiccant, comprising the steps of converting spaced-apart portions of the wall into hollow nipples extending beyond the other side of the wall; puncturing the nipples to form holes which are remote from the other side of the wall; and thereupon upsetting at least some of the nipples only from the other side of the wall to reduce the extent to which the at least some nipples project beyond the other side of the wall and to thereby impart to the holes an irregular shape as well as reduce the sizes of the respective holes to sizes which suffice to permit the flow of gaseous fluids but are insufficient to permit the passage of desiccant.

2. The method of claim 1, wherein said converting step includes deep drawing the spaced-apart portions of the wall in a direction from the one side beyond the other side with attendant reduction of thickness of those portions of the nipples which are remotest from the sides of the wall, said puncturing step including making holes in the remotest portions of the nipples and said upsetting step including moving the punctured remotest portions of at least some nipples toward the one side of the wall.

3. The method of claim 1, further comprising the steps of forming a flat web consisting of ductile metallic material and including the ductile wall, and transforming the web into the hollow spacer frame subsequent to said converting, puncturing and upsetting steps.

4. The method of claim 1, wherein at least one of said converting and upsetting steps includes providing at least some of the nipples with a substantially convex external surface at the other side of the wall.

5. The method of claim 1, wherein said converting step comprises imparting to each nipple a height of more than 0.2 mm in a direction away from the other side of the wall, said upsetting step comprising reducing the height of at least some nipples to a height of at least 0.2 mm.

6. Apparatus for varying the permeability of a ductile strip prior to conversion of a portion of the strip into a wall in a hollow spacer frame for confinement of a flowable solid particulate desiccant and for use between two panes defining a space which is surrounded by one side of the converted strip while the other side of the strip confronts the confined desiccant, comprising at least one tool having means for providing the strip with at least one row of nipples each extending beyond the other side and each having a hole remote from the other side of the strip; and means for reducing the height of at least some of the nipples—as measured from the other side of the strip—only from the other side with attendant imparting of an irregular shape to and reduction of the sizes of holes in the thus shortened nipples so that the reduced sizes suffice to permit the flow of gaseous fluids but are insufficient to permit the passage of desiccant.

7. Apparatus for varying the permeability of a ductile strip prior to conversion of a portion of the strip into a wall in a hollow spacer frame for confinement of a flowable desiccant and for use between two panes defining a space which is surrounded by one side of the converted strip while the other side of the strip confronts the confined desiccant, comprising at least one tool having means for providing the strip with at least one row of hollow nipples each extending beyond the other side of the strip, each having a tip remotest from the other side of the strip and each having a hole in the respective tip; and means for reducing the height of at least some of the nipples—as measured from the other side of the strip—with attendant reduction of the sizes of holes in the thus shortened nipples, said height reducing means including a roller having a peripheral surface including a section arranged to upset the tips of at least some of the nipples as a result of rolling of said roller along the other side of the strip.

8. Apparatus for varying the permeability of a ductile strip prior to conversion of a portion of the strip into a wall in a hollow spacer frame for confinement of a flowable desiccant and for use between two panes defining a space which is surrounded by one side of the converted strip while the other side of the strip confronts the confined desiccant, comprising at least one tool having means for providing the strip with at least one row of hollow nipples each extending beyond the other side and each having a hole remote from the other side of the strip, the other side of the strip having elongated portions which flank the at least one row of nipples; and means for reducing the height of at least some of the nipples—as measured from the other side of the strip—with attendant reduction of the sizes of holes in the thus shortened nipples, said height reducing means including a roller having a peripheral surface including two spaced-apart annular sections arranged to roll along said portions of the other side of the strip and an annular groove between said sections, said peripheral surface including a third section surrounding said groove and arranged to upset said at least some nipples while said annular sections roll along said portions of the outer side of the strip.

9. The apparatus of claim 8 for varying the permeability of a strip which is provided with nipples having a predetermined width—as measured transversely of the strip, wherein at least one portion of said groove has a width less than said predetermined width.

10. The apparatus of claim 8 for varying the permeability of a strip which is provided with nipples having a predetermined height prior to engagement by said height reducing means, wherein at least one portion of said groove has a depth less than said predetermined height.

11. The apparatus of claim 8, wherein said third section has a substantially U-shaped cross-sectional outline.

12. The apparatus of claim 8, wherein said third section has an at least partially concave cross-sectional outline.

13. The apparatus of claim 8, wherein said third section has a substantially trapeziform cross-sectional outline.

14. The apparatus of claim 8, wherein said groove includes at least one first portion having a first depth and at least one second portion having a greater second depth, said portions of said groove extending in the circumferential direction of said roller.

* * * * *